US006125666A

United States Patent [19]

Matsuda

[11] Patent Number: 6,125,666

[45] Date of Patent: Oct. 3, 2000

[54] NARROW WIDTH CROCHET KNITTING MACHINE HAVING DRIVING MECHANISM OF WEFT GUIDE BAR AND TWO OR MORE WARP GUIDE BARS

[75] Inventor: Yasuhiko Matsuda, Toyama-ken, Japan

[73] Assignee: YKK Corporation, Tokyo, Japan

[21] Appl. No.: 09/431,805

[22] Filed: Nov. 1, 1999

[30] Foreign Application Priority Data

Nov. 16, 1998 [JP] Japan ..... 10-325195

[51] Int. Cl.[7] ..... D64B 27/26

[52] U.S. Cl. ..... 66/207; 66/85 R

[58] Field of Search ..... 66/85 R, 84 R, 66/203, 204, 207, 82 A

[56] References Cited

U.S. PATENT DOCUMENTS 4,368,626 1/1983 Menegatto ..... 66/207
4,448,047 5/1984 Romano ..... 66/207
4,761,973 8/1988 Gangi ..... 66/207
5,544,500 8/1996 Speich ..... 66/207

*Primary Examiner*—Danny Worrell
*Attorney, Agent, or Firm*—Hill & Simpson

[57] ABSTRACT

There is provided a narrow width crochet knitting machine having a driving mechanism of a weft guide bar and two or more kinds of warp guide bars, which can form two or more kind of knitted loops in a narrow knitting space with a simple and compact mechanism. In a narrow width crochet knitting machine having a driving mechanism for independently and synchronously driving one or more weft guide bar, warp guide bars and a plurality of knitting needles, the warp guide bars comprise a plurality of guide bars for forming two or more kinds of knitted loops, at least one guide bar of the warp guide bars is arranged in a space for locating the weft guide bar, a support block of the one warp guide bar is arranged in a substantially identical plane with a support block of the weft guide bar, and the weft guide bar support block and the weft guide bar support block are vertically moved in the substantially identical plane by a main drive shaft independetnly from each other.

8 Claims, 1 Drawing Sheet

NARROW WIDTH CROCHET KNITTING MACHINE HAVING DRIVING MECHANISM OF WEFT GUIDE BAR AND TWO OR MORE WARP GUIDE BARS

BACKGROUND OF THE INVENTION

1. Field of the Invention

The present invention relates to a narrow width crochet knitting machine having a driving mechanism of a weft guide bar and warp guide bar, and more particularly, in addition to a driving mechanism of a warp guide bar for one kind of warp knitting structure such as a tricot knitting yarn or a chain knitting yarn, to a driving mechanism of warp guide bars for two or more kinds of warp knitting structure, which can simultaneously knit other structures.

2. Description of the Related Art

This type of narrow width crochet knitting machine is provided with the following guide bars; plural weft guide bars for supporting a plurality of tube-like guide needles for guiding a weft in-laid yarn, a warp guide bar for supporting a plurality of guide needles for guiding a warp knitting yarn for forming a warp knitted loop, and a needle bar for supporting a plurality of knitting needles for forming a knitted loop. These guide bars are driven by means of a main driving shaft of the knitting machine via a transmission mechanism while having mutual relations with their motions. However, this knitting machine is a small size because of knitting a narrow width knitted fabric, and a dedicated space of the knitting section is narrow and small.

A typical driving mechanism of the weft guide bar and needle bar has been disclosed in U.S. Pat. No. 4,448,047. Reading the specification, each opposite ends of first and second driving shafts are rotatably supported onto supports standing on right and left sides of a base, and each driving shaft is attached with an eccentric rotating member. One end of a connecting rod is connected to a bracket which is pivotally supported to the support, and the other end of the connecting rod is pivotally connected to the eccentric rotating member of the first driving shaft which is connected to an arm at the side opposite to the side where the arm is fixed to the needle bar. Thus the bracket and the eccentric rotating member are pivotally connected via the connecting rod.

On the other hand, each of the plurality of weft guide bars has a shaft end at both ends thereof. Each shaft end is inserted through a through hole formed in a block body so as to be horizontally slidably supported. The block body is guided by two guide rods standing on the upper surface of the support, and is supported so as to be vertically slidable. The eccentric rotating member of the second driving shaft and the block body are connected via a connecting rod.

The first driving shaft and the second driving shaft are connected via the main driving shaft and a transmission mechanism. When the main driving shaft is rotatably driven by a motor, the first driving shaft and the second driving shaft are rotated in association with each other, and the needle is moved forward and backward via the connecting rod. The plurality of weft guide bars move up and down via the connecting rod together with the block body. Moreover, a rocking rod end following a motion of cam driven by a rotation of the main driving shaft is abutted against a end face of the shaft end of each weft guide bar, and then, each weft guide bar horizontally reciprocates by the drive of the cam. Thus, the weft guide bar has a compound operation of the vertical direction and the horizontal direction.

A driving mechanism of the above weft guide bar is as disclosed in U.S. Pat. No. 4,448,047, in which a cam is attached to an end of a driving shaft connected at the opposite end to a main driving shaft via a gear, and the cam is abutted against a cam follower attached to one end of the warp guide bar. Moreover, an end of a connecting rod connected at the opposite end to an eccentric disc whose one end is attached to the main driving shaft is rotatably supported to the one end of the warp guide bar via an arm. When the main driving shaft is driven to rotate, the warp guide bar is reciprocated in a horizontal direction by a rotation of the cam; on the other hand, the warp guide bar is rocked forward and backward by the connecting rod. Thus, the warp guide bar has a compound operation of a horizontally reciprocating motion and a rocking motion to forward and backward directions.

Moreover, according to the invention disclosed in U.S. Pat. No. 4,448,047, in a general crochet knitting machine, a weft guide needle attached to one of the plurality of weft guide bars is urged against the weft guide bar so as to be able to be advanced and retracted. The weft guide needle is connected to a pulling rope, and pursuant to a pattern of paper pattern, the pulling rope is operated so as to arbitrarily advance and retract the weft guide needle, and thus, an embroidery knitted fabric having a desired pattern is knitted.

However, in the crochet knitting machine which can knit the embroidery knitted fabric, like the invention disclosed in the specification of U.S. Pat. No. 4,448,047, the plural weft guide bars are moved for inserting the identical weft in-laid yarn. And since an occupied space of a knitting section is restricted, this type of narrow width crochet knitting machine has generally one warp guide bar for forming a warp knitting loop, and merely knits one kind of knitting structure such as a tricot, chain stitch, two needle stitch or the like.

Meanwhile, with the use of this type of narrow width knitting machine, it is a common practice now that, as disclosed in the specification of U.S. Pat. No. 5,615,563, a tape is knitted while continuously knitting a coil-like engaging element row of a monofilament having a large diameter along one side edge in its longitudinal direction, so as to manufacture a slide fastener stringer. In order to securely fixing the engaging element row formed of the monofilament onto the tape, in addition to an operation for knitting the monofilament having a diameter larger than a warp and a weft in-laid yarn constituting a ground structure, it is necessary to have a complicate knitting structure including weft insertion and two or more kinds of knitted loops as a combination of one kind of knitted loop and an in-laid yarn is insufficient. Moreover, it is desirable to form various knitting pattern in a general tape, and in order to meet the request, two or more kinds of knitted loops must be combined.

As described above, with the use of the conventional narrow width crochet knitting machine, it is impossible to knit a tape having the aforesaid complicate structure combining weft insertion and two or more kind of knitted loops unless the knitting machine is made into a large size.

SUMMARY OF THE INVENTION

The present invention has been made in order to solve the aforesaid problem in the prior art. It is, therefore, an object of the present invention to provide a narrow width crochet knitting machine having a driving mechanism of a weft guide bar and two or more kinds of warp guide bars, which can form two or more kinds of knitted loops in a narrow knitting space with a simple and compact mechanism.

To achieve the above object, there provided a narrow width crochet knitting machine having a driving mechanism of a weft guide bar and two or more kinds of warp guide bars for independently and synchronously driving one or more weft guide bars, warp guide bars and a plurality of knitting needles for forming warp knitted loops, in which the warp guide bar includes a plurality of guide bars for forming two or more kinds of knitted loops, at least one guide bar of the warp guide bars is arranged in a space for locating the weft guide bar. And the machine further includes a support block of at least one warp guide bar which is arranged in a vertical plane which is substantially identical with that of a support block of the weft guide bar, and a driving mechanism of the warp guide bar for vertically moving the warp guide bar support block in the substantially identical plane independently from the weft guide bar support block as being driven by rotation of a main driving shaft which also drives the weft guide bar support block.

According to the present invention, one or more weft guide bar is located in addition to the conventional warp guide bar. The added warp guide bar is located in a space for locating the conventional weft guide bar, and the added warp guide bar is vertically driven in the substantially identical vertical plane with a space for driving the weft guide bar. Thus, it is possible to effectively utilize a narrow space, and there is no need of newly providing a space for driving the warp guide bar. Further, without interference between the added warp guide bar support block and the weft guide bar support block each other, a driving mechanism driven independently by the main driving shaft for driving the weft guide bar support block is employed; therefore, it is possible to form a desired warp knitted loop different from the warp knitted loop formed by the warp knitting guide bar which has been conventionally located.

Preferably, the warp guide bar support block has a warp guide bar support hole for slidably inserting and supporting an end portion of at least one warp guide bar, and the support block of the weft guide bars has one or more weft guide bar support hole for horizontally slidably inserting and supporting an end portion of the weft guide bar, and has a warp guide bar insertion slot for inserting an end portion of at least one warp guide bar so as to be vertically movable, at a portion facing the warp guide bar support hole.

With the above construction, at least one warp guide bar can be arranged in a space for locating the weft guide bar, and it is possible to move the warp guide bar support block independently from the weft guide bar support block without interfering with the weft guide bar support block, by vertically driving the warp guide support block independently in the vertical plane identical with that of the weft guide bar support block.

Further preferably, the weft guide bar support block is rotatably supported to an eccentric rotating member attached to the main driving shaft via a connecting rod, and the warp guide bar support block is rotatably supported to an eccentric rotating member attached to the main driving shaft via another connecting rod. Whereby it is possible to simultaneously drive the weft guide bar support block and the warp guide bar support block via the identical main driving shaft with a desired driving orbit.

Still preferably, the warp guide bar support block and a horizontal frame member are connected to each other by means of guide rods, and the weft guide bar support block has guide holes for vertically inserting the guide rods. With this construction, it is possible to independently drive the weft guide bar support block and the warp guide bar support block even their motions are made in the identical vertical plane.

Also preferably, the driving mechanism further includes a fixing block which is fixed on a support frame standing on a base, and is formed with a guide hole for vertically slidably guiding the guide rod. Thus, with the presence of the warp guide bar insertion slot of the warp guide bar support block, it is possible to vertically drive the weft guide bar support block with respect to the warp guide bar support block in the identical vertical plane, and to securely vertically drive the guide rods of the warp guide bar support block along the guide holes of the fixing block.

DETAILED DESCRIPTION OF THE PREFERRED EMBODIMENT

Figure 1:
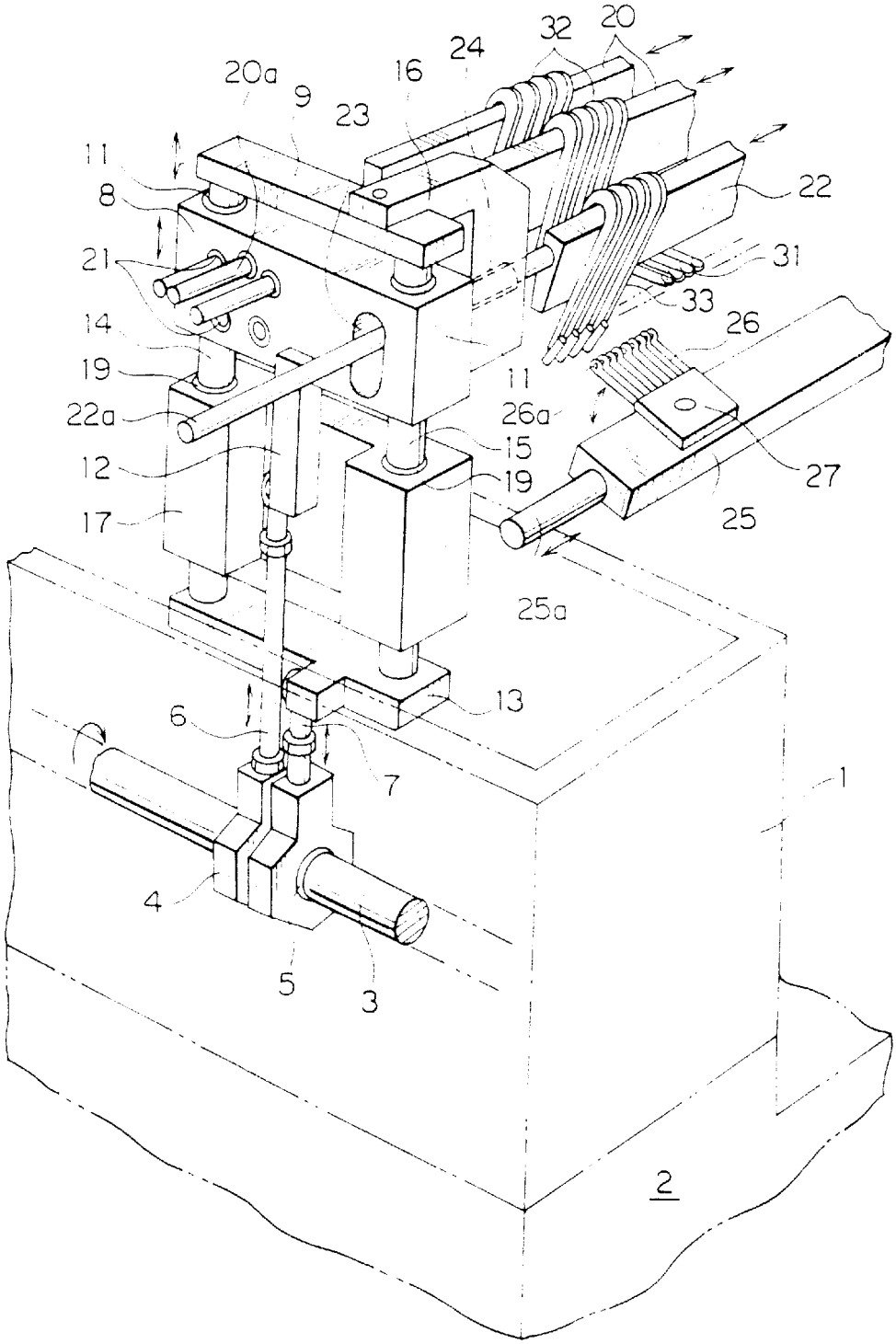
FIG. 1 is a fragmentary perspective view schematically showing a construction of a driving mechanism of a weft guide bar and two or more warp guide bars in a narrow width crochet knitting machine according to one typical embodiment of the present invention.

Preferred embodiment of the present invention will be described below with reference to the accompanying drawings.

In the following description, the details of a conventionally well known driving mechanism which is applicable to the present invention, such as a driving mechanism of a conventional warp guide bar and needle bar for forming a knitted loop, are omitted in order to avoid a redundancy. Also, a driving mechanism, which will be described below, is a merely typical example of the present invention, and various modifications may be made within a scope of equivalence of the present invention.

The most characteristic feature of the invention is that the second warp guide bar driving section and the weft guide bar driving section make different operations; nevertheless, both driving sections are driven in the substantially same locating space. As a result, it is possible to knit a desired warp knitting structure without enlarging a space for disposing the conventional weft guide bar and its driving mechanism locating space.

The accompanying drawing shows one embodiment of the present invention having the above features. FIG. 1 is a fragmentary perspective view showing an essential part of a driving mechanism of a weft guide bar and two or more kinds of second warp guide bars of a narrow width crochet knitting machine according to the embodiment of the present invention.

In FIG. 1, a reference numeral 1 denotes a support frame located on one end portion of a base 2, and a main driving shaft 3 extending in a horizontal longitudinal direction is rotatably supported on the support frame 1 via a bearing. The main driving shaft 3 is attached with first and second eccentric members 4 and 5 which are coaxially rotated. A phase difference of eccentric portions of the eccentric members 4 and 5 is determined by a timing of vertical motion of a weft guide bar 20 and a second warp guide bar 22 which will be described later. The weft guide bar 20 and the second warp guide bar 22 are attached with a plurality of weft guide needles 32 which have a shape of hook needle and a tubular member fixed at the distal end thereof and a plurality of warp guide needles 33 which have the same shape of the weft guide needle 32 with their each hook portion being hung thereon, respectively.

The eccentric members 4 and 5 are respectively connected to lower ends of first and second connecting rods 6 and 7 which are driven along a rotational circumferential surface of each of these eccentric members 4 and 5. Upper ends of the first and second connecting rods 6 and 7 are spherically connected to a rectangular weft guide bar support block 8 and a second warp guide bar support block 9 constituting a part of the support frame.

The weft guide bar support block 8 is formed with a first guide hole 11 which vertically extends and has a thrust bearing in its interior, at each of front and rear end portions thereof. An arm member 12 vertically extends from the lower surface of the block 8, and a lower end of the arm member 12 and the first connecting rod 6 are spherically connected to each other. Moreover, the second warp guide bar support block 9 is fixed onto each upper end of a pair of guide rods 14 and 15 which extends from both front and rear end portions of a horizontal frame member 13 located below. Namely, the second warp guide bar support block 9 constitutes a part of rectangular frame body, and the horizontal frame member 13 is spherically connected to an upper end of the second connecting rod 7 at the central portion thereof. A reverse L-shaped bracket 16 is vertically located on a knitting section side of the second warp guide bar support block 9.

On the other hand, the support frame 1 placed on the base 2 is fixedly provided with a fixing guide block 17 which has a substantially recess shape in its cross section. The guide block 17 is formed with a pair of second guide holes 19 which vertically extends and has a thrust bearing in its interior, at both end portions thereof. The paired guide rods 14 and 15 connecting the second warp guide bar support block 9 and the horizontal frame member 13 are inserted into the first guide holes 11 and the second guide holes 19 formed in respective front and rear end portions of the weft guide bar support block 8 and the fixing guide block 17.

The weft guide bar support block 8 is formed with weft guide bar support holes 21 which extend horizontally with respect to the base 2 in order to insert pins 20*a* projecting from the end portion of the plurality of weft guide bars 20 therein. Moreover, a second warp guide bar insertion slot 23 vertically extending is formed at a portion corresponding to the bracket 16 vertically hung from the second warp guide support block 9 in order to insert pins 22*a* horizontally projecting from the end portion of one or more warp guide bars 22 therein. On the other hand, a second warp guide bar support hole 24 is formed at a portion facing the second warp guide bar insertion slot 23 of the bracket 16 in order to insert the pin 22*a* of the second warp guide bar 22 therein. Each of the pin 20*a* of the weft guide bar 20 and the pin 22*a* of the second warp guide bar 22 are horizontally slidable in the weft guide bar support holes 21 and the second warp guide bar support hole 23, respectively.

A first warp guide bar shown by a reference numeral 25 is a tricot knitting guide bar, and the upper surface of the first warp guide bar 25 is attached with a plurality needle fixing members 27 arranged on which proximal ends of a plurality of warp guide needles 26 each having an eye hole 26*a* at the distal end thereof are fixed. Further, a pin 25*a* is projected from the end portion of the first warp guide bar 25. The pins 25*a* on both ends of the first warp guide bar 25 are supported on the support frame 1 so as to be horizontally slidable and rotatable. Thus the warp guide needle 26 having the eye hole 26*a* attached to the distal end thereof directed toward the knitting section is vertically rockable around the pin 25*a* while reciprocating in the right and left direction of the base 2, as shown by an arrow in FIG. 1.

According to the present invention, a generally known driving mechanism may be employed as a driving mechanism of the first warp guide bar 25. Also, the needle driving mechanism for sliding the plurality of knitting needles 31 forward and backward has no special relation with the present invention; therefore, their details are omitted.

In addition, a conventionally known driving mechanism as disclosed in the specification of U.S. Pat. No. 4,417,455 may be employed as the horizontal driving mechanism of the weft guide bar 20, the second warp guide bar 22 and the first warp guide bar 25; therefore, their details are omitted. In brief, the driving mechanism is as follows. When the main driving shaft 3 is rotatably driven, a follower abutting against a cam member (not shown) rotating by the rotation of the main driving shaft 3 is rocked, and thereby, each end face of the above pins 20*a*, 22*a* and 25*a* of the guide bars 20, 22 and 25 urged toward one direction is pressed at a desired timing and stroke so as to move these bars 20, 22 and 25 horizontally in the right and left direction.

In the driving mechanism of the plurality of weft guide bars and the first and second warp guide bars in the narrow width crochet knitting machine having the aforesaid construction, when the main driving shaft 3 is rotatably driven by a drive motor (not shown), the first and second eccentric members 4 and 5 are rotated, and thereby, the first and second connecting rods 6 and 7 are vertically reciprocated. When the first connecting rod 6 vertically reciprocates, the weft guide bar support block 8 spherically connected to the upper end of the connecting rod 6 via the arm member 12 is guided by the pair of front and rear guide rods 14 and 15 connecting the second warp guide bar support block 9 and the horizontal frame member 13 so as to be vertically reciprocated, and thus, the plurality of weft guide bars 20 inserted and supported in the weft guide bar support hole 21 formed in the weft guide bar support block 8 are together moved up and down.

On the other hand, when the second connecting rod 7 vertically reciprocates by the rotation of the second eccentric member 5, the rectangular frame body, having the warp guide bar support block 9, spherically connected to the upper end of the connecting rod 7 is vertically reciprocated, and then, the second warp guide bar 22 having the pin 22*a* inserted and supported in the second warp guide bar support hole 24 formed in the reverse L-shaped bracket 16 vertically located on the side of the knitting section of the second warp guide bar support block 9 and inserting the pin 22*a* through the second warp guide bar insertion slot 23 formed in the weft guide bar support block 8 is guided by the second guide hole 19 vertically formed in the fixing guide block 17, and then, is vertically reciprocated without interfering with the weft guide bar support block 8. Also, the first warp guide bar 25 is vertically reciprocated.

The aforesaid guide bars 20, 22 and 25 are reciprocated, and simultaneously, the follower is rocked by the cam (not shown) rotating together with the main driving shaft 3. Then, the rockable end of the follower is pressed against the pins 20*a*, 22*a* and 25*a* of guide bars 20, 22 and 25 urged toward the horizontal direction, and thus, these guide bars 20, 22 and 25 are horizontally reciprocated in the rihgt and left direction. Therefore, the plurality of guide needles 32, 33 and 26 fixed onto guide bars 20, 22 and 25 are in exact timing with each other, and make a compound operation combining the vertical and horizontal operations in a predetermined stroke. At this time, the compound knitting needle 31 repeats a predetermined operation, and then, the weft in-laid yarn is inserted into a predetermined knitted loop so as to form two or more kinds of knitted loops of a chain stitch and tricot, and thus, a desired warp knitting tape can be knitted. As is seen from the above description, in the narrow width crochet knitting machine according to the present invention, by employing a mechanism for independently vertically moving the weft guide bar support block 8 and the second warp guide bar support block 9 which are vertically mutually moving in the substantially identical vertical plane, there is no need of providing a special space for locating the second warp guide bar 22, and therefore, it is possible to utilize the conventional space for locating the weft guide bar 20. Further, when the second warp guide bar 22 is driven, it is possible to form a warp knitted loop which is different from the warp knitted loop formed by the first warp guide bar 25 which has been located in the conventional case.

What is claimed is:

1. A knitting machine capable of forming at least two kinds of knitted loops, comprising:

at least one weft guide bar having a plurality of weft guide needles;

a first warp guide bar having a plurality of warp guide needles and a second warp guide bar having a plurality of knitting needles;

a weft guide bar support block supporting the at least one weft guide bar;

a warp guide bar support block supporting the second warp guide bar, the warp guide bar support block and the weft guide bar support block being positioned in substantially the same vertical plane; and a driving mechanism linked to the weft and warp guide bar support blocks and to the first warp guide bar, the driving mechanism independently driving the weft and warp guide bar support blocks in the vertical plane.

2. A knitting machine according to claim 1, wherein the warp guide bar support block has a warp guide bar support hole, an end portion of the second warp guide bar being slidably inserted in the warp guide bar support hole, and the support bock of the at least one weft guide bar has a weft guide bar support hole and a warp guide bar insertion slot, an end portion of the at least one guide bar being slidably inserted in the weft guide bar support hole, and an end portion of the second warp guide bar being inserted in the warp guide bar insertion slot.

3. A knitting machine according to claim 2, wherein the weft guide bar support block is rotatably supported to an eccentric rotating member attached to a main driving shaft via a connecting rod, and the warp guide bar support block is rotatably supported to an eccentric rotating member attached to the main driving shaft via a connecting rod.

4. A knitting machine according to any one of claims 1 to 3, wherein the warp guide bar support block and a horizontal frame member are connected to each other by guide rods, and the weft guide bar support block has guide holes for vertically inserting the guide rods.

5. A knitting machine according to claim 4, wherein the machine further comprises a fixing block which is fixed on a support frame standing on a base, and is formed with guide holes for vertically slidably guiding the guide rods.

6. A knitting machine according to claim 1, wherein the weft guide bar support block is rotatably supported to an eccentric rotating member attached to a main driving shaft via a connecting rod, and the warp guide bar support block is rotatably supported to an eccentric rotating member attached to the main driving shaft via a connecting rod.

7. A knitting machine according to claim 6, wherein the warp guide bar support block and a horizontal frame member are connected to each other by guide rods, and the weft guide bar support block has guide holes for vertically inserting the guide rods.

8. A knitting machine according to claim 7, wherein the machine further comprises a fixing block which is fixed on a support frame standing on a base, and is formed with guide holes for vertically slidably guiding the guide rods.

* * * * *

UNITED STATES PATENT AND TRADEMARK OFFICE

CERTIFICATE OF CORRECTION

PATENT NO. 6,125,666

DATED: October 3, 2000

INVENTORS: Yasuhiko Matsuda

It is hereby certified that errors appear in the above-identified patent and that said Letters Patent is hereby corrected as shown below:

On the Title Page, Item [57], in the Abstract,
lines 3-4, "two or more kind" should read --two or more kinds--;
lines 7-8, "one or more weft guide bar" should read --one or more weft guide bars--; and
line 17, "independetnly" should read --independently--.

Signed and Sealed this

First Day of May, 2001

*Attest:*

Nicholas P. Godici

NICHOLAS P. GODICI

*Attesting Officer*

*Acting Director of the United States Patent and Trademark Office*